United States Patent [19]

Davis

[11] 4,180,111

[45] Dec. 25, 1979

[54] HANDBAG

[76] Inventor: Terri Davis, 4106 S. Harvard Blvd., Los Angeles, Calif. 90062

[21] Appl. No.: 959,925

[22] Filed: Nov. 13, 1978

[51] Int. Cl.[2] ..... A45C 3/04

[52] U.S. Cl. ..... 150/1.7; 229/54 R

[58] Field of Search ..... 150/1.7, 12, 28 R, 30, 150/33; 190/43; 229/54 R, 54 C

[56] References Cited

U.S. PATENT DOCUMENTS 1,719,455 7/1929 Steckler ..... 150/1.7

1,730,603 10/1929 Carlson ..... 150/1.7

*Primary Examiner*—Donald F. Norton

*Attorney, Agent, or Firm*—Jack C. Munro

[57] ABSTRACT

A handbag which is designed to be foldable to assume different positions. The first position is a completely closed position with the handbag being collapsed and not capable of carrying any articles. The second position is with the handbag having a container which is substantially the size of a conventional handbag. The third position is with the handbag having an enlarged container to facilitate carrying of larger size articles.

3 Claims, 3 Drawing Figures

Fig. 1
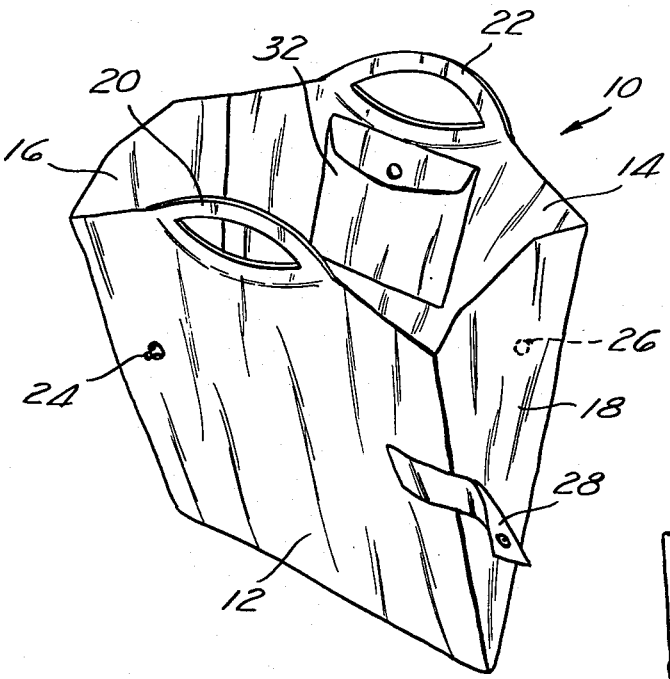
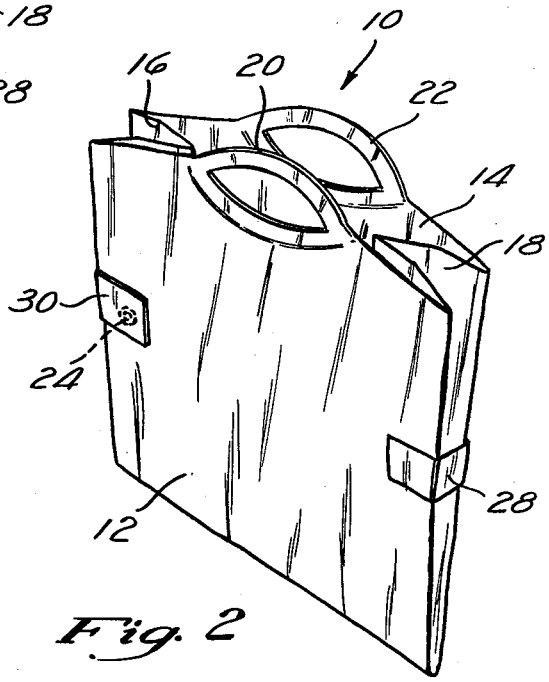
Fig. 2
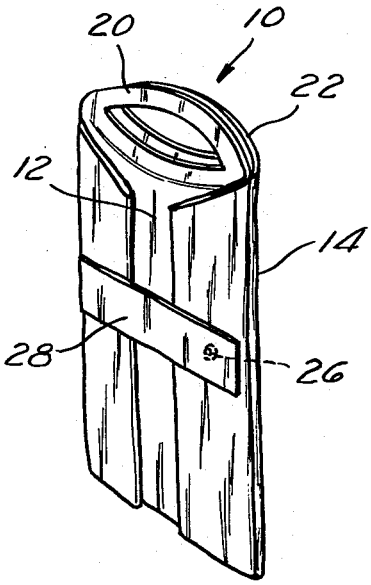
Fig. 3

HANDBAG

BACKGROUND OF THE INVENTION

The field of this invention relates to carrying articles and more particularly to a handbag which is designed particularly to be carried by women.

In the constructing of the conventional handbag, they are constructed to be of a pre-established size. There is no altering of the enclosed container of the handbag to have the container assume various sizes. At times it may be desirable to have the handbag of the size of a conventional handbag and then at times also to have the handbag assume an enlarged size such as was referred to as a conventional shopping bag. In most situations, the conventional handbag size would be adequate. However, in some instances such as during the purchase of a larger sized article, it would be desirable if the handbag could assume a larger size configuration so as to accommodate carrying of the larger article.

SUMMARY OF THE INVENTION

The structure of this invention employs the use of thin sheet material flexible front wall and a thin sheet material back wall. The back wall and the front wall are attached together at the bottom edge thereof with the tip edges of each of the front wall and back wall including a handle to facilitate carrying of the handbag of this invention. The adjacent lateral edges of the front wall and back wall are attached together by side walls. When these sidewalls are located in a perpendicular relationship with respect to the front wall and the back wall, the enclosed container of the handbag is in its largest size. With the side walls folded and located substantially parallel to the front wall and back wall and in between such, the enclosed container of the handbag is in its smaller sized configuration. The lateral portions of the front wall and back wall can then be folded over upon themselves which causes a complete closing of the container and substantially condenses the overall size of the handbag of this invention. A releasable snap and strap assembly is mounted on both the front wall and the back wall and cooperate together to retain the handbag in both the smaller size configuration and the closed configuration.

The primary objective of this invention is to construct a handbag which can be expanded to an enlarged shopping bag configuration or located in a smaller normal sized handbag configuration or can be completely collapsed when empty into a small overall configuration to facilitate carrying.

BRIEF DESCRIPTION OF THE DRAWING

FIG. 1 is an isometric view of the handbag of this invention showing the handbag in the enlarged shopping bag configuration;

FIG. 2 is an isometric view of the handbag of this invention showing the handbag in the smaller size or normal handbag configuration; and FIG. 3 is an isometric view of the handbag of this invention showing the handbag in the completely closed configuration.

DETAILED DESCRIPTION OF THE SHOWN EMBODIMENT

Referring particularly to the drawing there is shown the handbag 10 of this invention which is composed generally of a front wall 12, a back wall 14 and sidewalls

16 and 18. The front wall 12 is integrally attached to the back wall 14 at the bottom edge thereof.

The upper end of the front wall 12 includes a handle 20 and a similar handle 22 is attached to the upper end of the back wall 14. The handles 20 and 22 are to cooperate together to facilitate carrying of the handbag 10.

Fixedly secured to the front wall 12 is a snap 24. A similar such snap 26 is secured to the exterior surface of the back wall 14.

A strap 28 is attached to the exterior surface of the front wall 12 with a similar strap 30 being attached to the exterior surface of the back wall 14.

To facilitate the carrying of smaller sized articles, an inside pocket 32 is mounted on the interior surface of the back wall 14.

With the handbag 10 in the position shown in FIG. 1 of the drawing, the sidewalls 16 and 18 are located substantially perpendicular to the front wall 12 and the back wall 14. This is a position in which the handbag 10 assumes its largest carrying container configuration. Essentially the size of the handbag 10 in the position shown in FIG. 1 resembles a conventional shopping bag.

Referring particularly to FIG. 2 of the drawing, the sidewalls 16 and 18 are shown to be folded and located between the front wall 12 and the back wall 14 and substantialy parallel thereto. The inside carrying container portion of the handbag 10 has assumed a smaller size and is for all practical purposes assumes a conventional handbag size. In order to retain the handbag 10 in this position, the strap 28 is to be secured to the snap 26 with the strap 30 being secured to the snap 24.

Also, handbag 10 may be carried in a position in which it is not carrying any contents. In this position the lateral sides of the front wall and back wall are folded over upon themselves as shown in FIG. 3 of the drawing. In this position the strap 28 is disconnected from the snap 26 but is then connected to the snap 24. The overall configuration of the handbag 10 in the closed or empty position is substantially smaller than in either of its other two positions.

What is claimed is:

1. A handbag comprising:

a thin sheet material front wall, said front wall having a first upper end and a first lower end;

a thin sheet material back wall, said back wall having a second upper end and a second lower end, said first lower end being secured to said second lower end;

a first side wall being integrally attached to an adjacent pair of sides of said front wall and said back wall;

a second side wall being integrally attached to the opposite adjacent pair of sides of said front wall and said back wall;

said front wall and said back wall and said side walls cooperating to form an enclosed container, said container assuming its largest size with said side walls being located substantially perpendicular to said front wall and said back wall, said container assuming a smaller size with said side walls being folded and located substantially parallel to said front wall and said back wall, releasable connecting means attached to both said front wall and said back wall to retain said container in said smaller size, said container assuming a closed size with said side walls in said folded position and lateral portions of said front and back walls being folded upon themselves and said releasable connecting means cooperating to retain the said container in said closed size.

2. The handbag as defined in claim 1 including:

a first handle means attached to said first upper end of said front wall, a second handle means attached to said second upper end of said back wall, said handle means to be grasped to facilitate operating of said handbag.

3. The handbag as defined in claim 2 including:

inside pocket located within said enclosed container.

* * * * *